US006908164B2

(12) United States Patent
Gilbert et al.

(10) Patent No.: US 6,908,164 B2
(45) Date of Patent: Jun. 21, 2005

(54) POWER CONTROL CIRCUIT FOR PRINTERS AND OTHER DEVICES

(75) Inventors: Hugh E. Gilbert, Versailles, KY (US); Marvin Nicholson, III, Lexington, KY (US); Ricky E. Robbins, Harrodsburg, KY (US); Michael K. Webb, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/342,409

(22) Filed: Jan. 13, 2003

(65) Prior Publication Data

US 2004/0135834 A1 Jul. 15, 2004

(51) Int. Cl.[7] ..... B41J 23/00
(52) U.S. Cl. ..... 347/5; 399/88; 323/901
(58) Field of Search ..... 347/5; 358/1.14; 399/88; 323/318, 901; 713/300, 330; 400/54

(56) References Cited

U.S. PATENT DOCUMENTS

| | | | | |
|---|---|---|---|---|
| 3,863,077 A | * | 1/1975 | Bienkowski | 290/38 R |
| 4,631,418 A | * | 12/1986 | Toyomura | 327/545 |
| 5,289,045 A | | 2/1994 | Lavin et al. | |
| 5,457,516 A | | 10/1995 | Kim | |
| 5,499,184 A | | 3/1996 | Squibb | |
| 5,511,205 A | * | 4/1996 | Kannan et al. | 713/324 |
| 5,541,458 A | | 7/1996 | Hirst | |
| 5,545,978 A | | 8/1996 | Pontius | |
| 5,844,813 A | | 12/1998 | Tateyama | |
| 5,848,848 A | * | 12/1998 | St. Jean | 400/88 |
| 5,995,397 A | | 11/1999 | Kim | |
| 6,075,352 A | | 6/2000 | Kates et al. | |
| 6,093,916 A | | 7/2000 | Toyoizumi | |
| 6,097,616 A | | 8/2000 | Iwasaki | |
| 6,100,725 A | | 8/2000 | Aswell et al. | |
| 6,172,883 B1 | | 1/2001 | Kates et al. | |
| 6,191,662 B1 | | 2/2001 | Volk | |
| 6,195,271 B1 | | 2/2001 | Suzuki et al. | |
| 6,265,941 B1 | | 7/2001 | Lopata | |
| 6,285,223 B1 | | 9/2001 | Smith | |
| 6,456,131 B1 | | 9/2002 | Tran | |
| 2002/0027787 A1 | | 3/2002 | Nishida et al. | |
| 2002/0080630 A1 | | 6/2002 | Hodge, Jr. | |
| 2002/0131788 A1 | | 9/2002 | Nakaya | |

* cited by examiner

*Primary Examiner*—Lamson Nguyen
*Assistant Examiner*—Blaise Mouttet
(74) *Attorney, Agent, or Firm*—Thompson Hine LLP

(57) ABSTRACT

A power control circuit is connected between a power source and an electronic controller in a device such as a printer and includes a latchable power delivery state for delivering power to an electronic controller of the device. Temporary closure of a switch latches the power control circuit in its power delivery state. The electronic controller subsequently detects temporary closure of the switch and responds with an output signal that unlatches the power control circuit into a power non-delivery state. The power control circuit may include an associated kick-start circuit portion for causing the power control circuit to latch into its power delivery state in response to initial application of power by the power source.

31 Claims, 1 Drawing Sheet

POWER CONTROL CIRCUIT FOR PRINTERS AND OTHER DEVICES

TECHNICAL FIELD

The present invention relates generally to power control circuits and, more particularly, to a circuit for controlling the application of power to the primary electronics in devices such as printers.

BACKGROUND OF THE INVENTION

Energy standards as applicable to printers currently provide that standby power consumption should be below 1 watt, and as applicable to printer/fax combinations currently require that standby power consumption be below 2 watts.

Accordingly, it would be advantageous to provide a relatively simple power control circuit for use in printers and other electronic devices to provide a low power off state for the devices.

SUMMARY OF THE INVENTION

In one aspect, a printer includes a DC power source, an electronic controller for controlling operations of the printer including a printing mechanism of the printer, and a power control circuit connected between the DC power source and the electronic controller for controlling delivery of DC power to the electronic controller. The power control circuit includes a power control transistor, a user closeable switch and latching circuitry. The power control transistor is connected between the DC power source and the electronic controller. An ON state of the power control transistor effects DC power delivery to the electronic controller and an OFF state of the power control transistor prevents DC power delivery to the electronic controller. The user closeable switch is connected in line with at least one other circuit component that receives power from the DC power source when the user closeable switch is closed to set up a voltage condition across terminals of the power control transistor that places the power control transistor in its ON state. The user closeable switch is biased into an open condition. The latching circuitry is connected in the power control circuit and latches into a conducting state upon closure of the user closeable switch to maintain the voltage condition even after the user closeable switch returns to its open condition.

In another aspect, a printer includes a DC power source, an electronic controller for controlling operations of the printer including a printing mechanism of the printer, and a power control circuit including a power control transistor connected between the DC power source and the electronic controller. An ON state of the power control transistor effects DC power delivery to the electronic controller and an OFF state of the power control transistor prevents DC power delivery to the electronic controller. Latching circuitry is connected to the power control transistor and has a latched state that maintains a voltage condition across terminals of the power control transistor to hold the power control transistor in its ON state. A kick-start circuit is connected to the power control circuit and is configured to temporarily set up the voltage condition when DC power is initially output by the power source. The kick-start circuit sets up the voltage condition for a time period sufficient to cause the latching circuitry to latch into its latched state.

In yet another aspect, a printer includes a DC power source and an electronic controller for controlling operations of the printer including a printing mechanism of the printer.

A power control circuit is connected between the DC power source and the electronic controller for controlling delivery of DC power to the electronic controller. The power control circuit includes latching circuitry for latching the power control circuit in a power delivery state to deliver DC power through the power control circuit to the electronic controller. A control path is connected between the electronic controller and the latching circuitry enabling the electronic controller to unlatch the power control circuit into a power non-delivery state that causes cessation of DC power delivery through the power control circuit to the electronic controller.

In a further aspect, a printer includes a DC power source, an electronic controller and a power control circuit connected between the DC power source and the electronic controller. The power control circuit has both a latchable power delivery state in which power is delivered from the DC power source to the electronic controller and a power non-delivery state in which DC power is not delivered from the DC power source to the electronic controller. The power control circuit includes a user closeable switch connected therein and a kick-start circuit portion. When the power control circuit is in the power non-delivery state, temporary closure of the user closeable switch causes the power control circuit to latch into its power delivery state. When the power control circuit is in the power non-delivery state, initial output of power from the DC power source causes the kick-start circuit to latch the power control circuit into its power delivery state.

In another aspect, a power control circuit for use in an electronic device includes an input for connecting to a power source to receive power therefrom, an output for connecting to an electronic controller of an electronic device, and a power control transistor connected between the input and the output. An ON state of the power control transistor makes a power path from the input to the output and an OFF state of the power control transistor breaks the power path. A switch is connected in line with at least one other circuit component and the input for setting up a voltage condition across terminals of the power control transistor when the switch is closed to place the power control transistor in its ON state. The switch is biased into an open condition. Latching circuitry is connected in the circuit for latching into a conducting state upon closure of the switch to maintain the voltage condition even after the switch returns to its open condition.

In yet another aspect, a power control circuit for use in an electronic device includes an input for connecting to a power source to receive power therefrom, an output for connecting to an electronic controller of an electronic device, and a power control transistor connected between the input and the output. An ON state of the power control transistor making a power path from the input to the output and an OFF state of the power control transistor breaking the power path. Latching circuitry is connected to the power control transistor and has a latchable conducting state for maintaining the power control transistor in its ON state. A kick-start circuit is connected to temporarily set up a voltage condition across terminals of the power control transistor when power is initially received at the input, the voltage condition placing the power control transistor in its ON state. The kick-start circuit configured to set up the voltage condition for a time period sufficient to cause the latching circuitry to latch into its conducting state.

In still another aspect, a printer includes a DC power source, an electronic controller for controlling operations of the printer including a printing mechanism of the printer, and a power control circuit connected between the DC power source and the electronic controller for controlling delivery of DC power to the electronic controller. The power control circuit includes a switching device connected between the DC power source and the electronic controller, where a closed state of the switching device effects DC power delivery to the electronic controller and an open state of the switching device prevents DC power delivery to the electronic controller. A user controlled switch is connected in line with at least one other circuit component that receives power from the DC power source when the user controlled switch is closed to set up a condition in the power control circuit that places the switching device in its closed state, the user controlled switch being normally open. Latching circuitry is connected in the power control circuit, the latching circuitry latching into a conducting state upon closure of the user controlled switch to maintain the condition even after the user controlled switch opens.

In a further aspect, a printer includes a DC power source, an electronic controller for controlling operations of the printer including a printing mechanism of the printer and a power control circuit including a switching device connected between the DC power source and the electronic controller. A closed state of the switching device effects DC power delivery to the electronic controller and an open state of the switching device prevents DC power delivery to the electronic controller. Latching circuitry is connected to the switching device and having a latched state that maintains a circuit condition that holds the switching device in its closed state. A kick-start circuit is connected to the power control circuit and configured to temporarily set up the circuit condition when DC power is initially output by the power source. The kick-start circuit sets up the circuit condition for a time period sufficient to cause the latching circuitry to latch into its latched state

DETAILED DESCRIPTION

Figure 1:
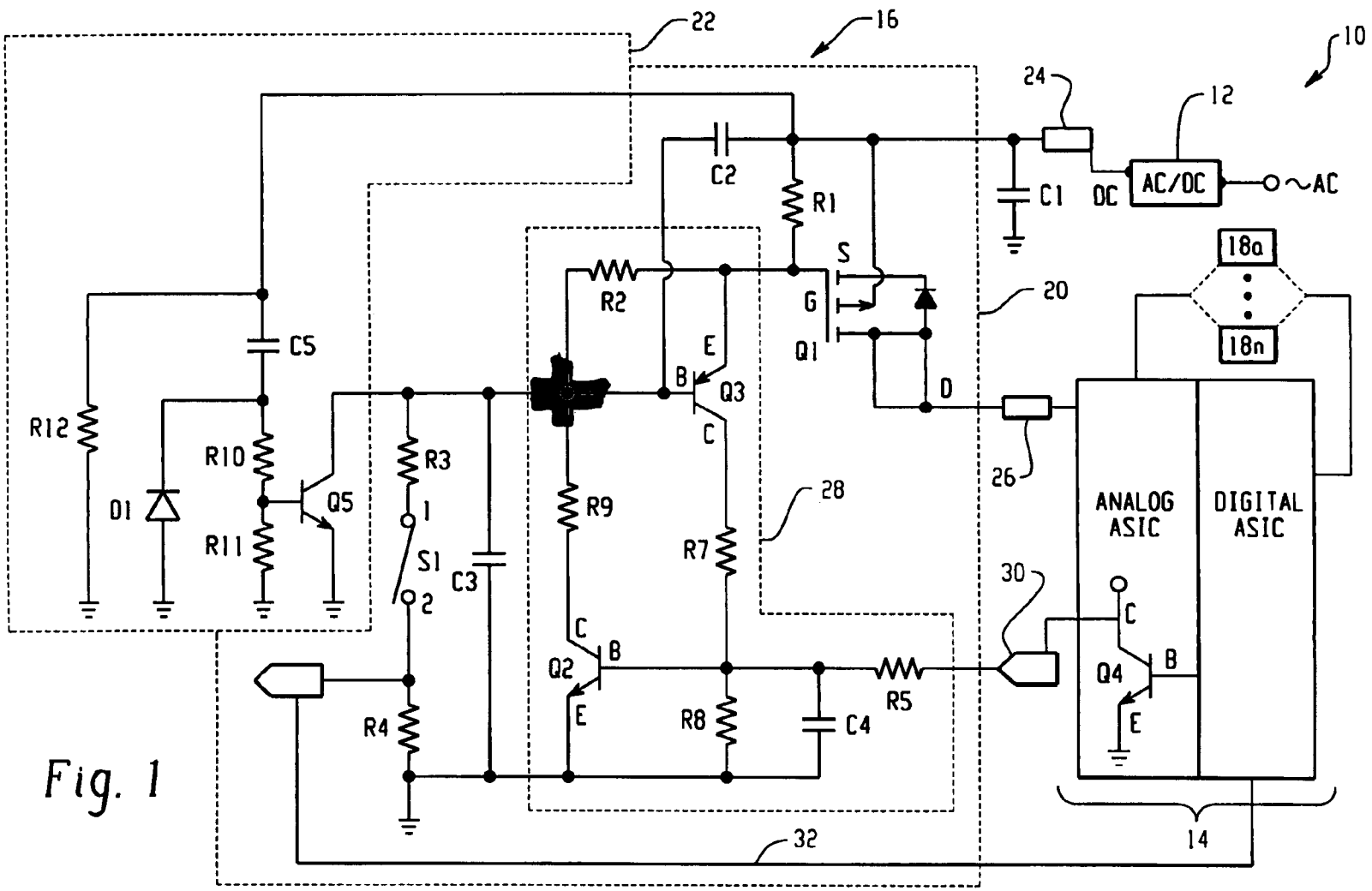
FIG. 1 is a circuit schematic of a printer system including one embodiment of a power control circuit.

Referring to FIG. 1, a printer system 10 is shown and includes a power source 12, an electronic controller 14 and a power control circuit 16 connected between the power source 12 and the electronic controller 14. The electronic controller 14 is configured to control the operations of the printer and is connected to various components 18*a*–18*n* of the printer for that purpose. In one embodiment the electronic controller 14 includes both an analog ASIC portion and a digital ASIC portion. By way of example, the components 18*a*–18*n* could be various motors, solenoids, lights, display(s) and sensors located throughout a typical printer, as well as the print mechanism(s) of the printer. In one embodiment the printer is an inkjet printer and the print mechanisms are inkjet printheads mounted on a carriage for movement across a paper path as is well known in the art. However, it is recognized that in other embodiments printer system 10 could represent another type of printer such as a dot-matrix printer, a thermal printer, a laser jet printer or any other type of printer. As used herein the term "printer" is intended to encompass any device which is capable of placing indicia on a media, regardless of the type of print technology and printer mechanism used. Further, the term "printer" specifically encompasses both stand alone units and multi-function devices incorporating the capability of placing indicia on a media (e.g., devices commonly referred to as combination fax/printers).

In the illustrated embodiment the power source 12 is provided at the output of an AC/DC power supply/adapter having an input to receive AC power, typically from a standard 120 V outlet. However, other power sources could be provided, and in some cases the power source could simply be an input line that is intended to be connected to a source of power when the printer is installed for use (e.g., a printer that does not have is own power supply but instead receives power from a separate device when installed).

The power supply circuit 16 includes a primary power supply circuit portion 20 and a kick-start circuit portion 22 connected thereto. The output of the AC/DC power supply is connected to an input 24 of the power supply circuit 16 and the electronic controller 14 is connected to an output 26 of the circuit. A power control transistor Q1 is connected between the input 24 and output 26. An ON state of the power control transistor Q1 makes a power path from the input 24 to the output 26, thereby delivering DC power from the power source 12 to the electronic controller 14. An OFF state of the power control transistor Q1 breaks the power path, preventing the delivery of DC power from the power source 12 to the electronic controller 14. The remainder of the circuit 16 is primarily configured to establish the manner in which the ON/OFF state of the power control transistor Q1 is set as will be described in detail below.

In the illustrated embodiment power control transistor Q1 is a P-Channel Enhancement Mode Field Effect Transistor such as the NDT2955 available from Fairchild Semiconductor. Other type of transistors or other switching devices could be used. A user closeable switch S1 or other user controlled switching device is connected to the power source 12 in line with resistors R1, R2 and R3. The switch S1 may be biased into the normally open condition shown such that when a user depresses a button on the printer the switch S1 closes, and when the user releases the button the switch S1 opens. The resistor R2 is one component of latching circuitry 28 provided in the circuit portion 20. The latching circuitry 28 has a latchable conducting state that can be used to maintain or latch the power control transistor in its ON state as will become apparent below.

Assuming the power control transistor Q1 is in its OFF state and the latching circuitry 28 is likewise in its non-conducting state, the output 26 is low (i.e., DC power is not being delivered to the output 26). Temporary closure of the switch S1 by a user will effect power delivery to the electronic controller 14 as follows. When the switch S1 initially closes, current flow along the path defined by resistors R1, R2, R3, switch S1 and resistor R4 causes a voltage condition across the source S to gate G terminals of the power control transistor Q1 that places the power control transistor Q1 in its ON state, the voltage condition being a voltage drop from source S to gate G in the illustrated embodiment. DC power is then delivered through the transistor to the electronic controller 14, causing a latching circuitry control input 30, which connects through resistor R5 to the base (i.e., the control input) of transistor Q2, to be set in a high impedance state. In the illustrated embodiment control input 30 is connected to the open collector of a normally OFF transistor Q4 in an analog ASIC of the electronic controller 14, and the electronic controller 14 includes a digital ASIC that can turn transistor Q4 ON.

At the same time, current flow through resistor R2 causes a voltage drop from the emitter E to base B of transistor Q3, which in the illustrated embodiment is a PNP transistor, thereby biasing transistor Q3 into its ON state, conducting state. When transistor Q3 conducts, current flows through resistors R7 and R8 and the voltage across R8 is applied at the base of transistor Q2. In the illustrated embodiment, Q2 is an NPN transistor, and the voltage biases transistor Q2 into its ON, conducting state. Once transistor Q2 is turned ON, current flows from the power source 12 through resistors R1, R2 and R9, even if the user releases the switch S1 to its open condition. Current flow through transistor Q3 keeps transistor Q2 in its ON state and current flow through transistor Q2 keeps transistor Q3 in its ON state, thereby latching the circuitry 28 in its conducting state to maintain or latch the power control transistor Q1 in its ON state.

Assuming power control transistor Q1 is latched in its ON state by latching circuitry 28, temporary closure of switch S1 by a user can effect cessation of power delivery to the electronic controller 14. As shown, a switch condition feedback path 32 is provided from the circuit portion 20 to the electronic controller 14. In the illustrated embodiment the feedback path 32 is input to the digital ASIC of the electronic controller 14.

In one embodiment, the electronic controller 14 may take different actions depending on whether the switch S1 is closed momentarily or closed for a longer, threshold time period such as a few seconds. When the switch S1 is momentarily closed a high signal is momentarily applied to path 32 due to the voltage drop across resistor R4 and the electronic controller 14 responds by placing the printer in a "soft off state" by powering down various of the printer components for energy conservation. During such a soft off state the power control transistor Q1 maintains its ON state and a power on LED color may be changed to visually indicate to users the soft off state of the printer 10. The electronic controller 14 wakes up, returning the printer 10 to its operating power state when it receives USB data (e.g., data to effect a print operation). When the switch S1 is closed for the longer, threshold time period, the electronic controller 14 responds by completely turning off power in the manner to be described below.

In another embodiment the electronic controller 14 may respond by turning off power completely upon momentary closure of the switch S1.

Regardless of the particular embodiment, when electronic controller 14 recognizes a high signal on path 32 as an indication that a user wants to power off the printer 10 completely, the electronic controller 14 first runs through a power shut down sequence (e.g., parking the print head carriage, expelling media, communicating with the print driver, etc.). Then the electronic controller 14 causes the control input 30 of the latching circuitry 28 to be pulled low through transistor Q4 by turning ON transistor Q4. This operation grounds the base of transistor Q2 causing it to turn OFF. When transistor Q2 turns OFF, current flow through resistor R2 stops, causing transistor Q3 to also turn OFF. At that point, current stops flowing through resistor R1 and the source to gate voltage drop across power control transistor Q1 is eliminated causing the power control transistor Q1 to turn OFF. When transistor Q1 turns OFF, power delivery to the electronic controller 14 stops. It is recognized that the electronic controller 14 could be configured to also initiate the shutdown via control input 30 based upon the detection of some other condition if desired.

In circuit portion 20, capacitor C1 acts as a filter for the incoming DC voltage from the power source 12. Capacitor C2 limits the turn on speed of transistor Q1 in order to maintain inrush current to the transistor at an acceptable level. Capacitor C3 serves a dual function of stabilizing the voltage at the base of transistor Q3 and assisting capacitor C2 in inrush current control for transistor Q1. Capacitor C4 acts a filter to stabilize the base-emitter voltage of transistor Q2.

Referring now to the kick-start circuit portion 22, the purpose of this portion of the circuit 16 is to automatically place the power control transistor Q1 in its ON state whenever power is initially applied by the power source (e.g., when the user plugs a power adapter into the machine, when machine's power adapter is plugged into a power strip and the power strip is cycled off and then back on again, or when the AC power to the power adapter has an interruption or outage). Before power is applied to input 24, transistor Q5 is in its OFF state and the voltage across capacitor C5 is zero. When power is first applied to input 24 the applied DC voltage appears on both sides of capacitor C5 with respect to ground. Because the potential across the capacitor C5 cannot change instantaneously, the side of capacitor C5 connected to resistor R10 discharges to ground through resistors R10 and R11, which resistors act to slow down the discharge rate. The resistors R10 and R11 set up a voltage divider that is connected to the base of transistor Q5 to reduce the voltage at its base. The transistor Q5 is turned ON temporarily while the capacitor C5 discharges. The duration the transistor Q5 is turned on can be calculated as follows:

$$t=-(R10)(C5)1n[Vc/Vi] \quad (1)$$

where Vc is the voltage across the divider at which the transistor Q5 will shut OFF, and Vi is the voltage applied at the input 24. Resistor R11 does not factor into the equation because a potential of approximately 0.7 volts, due to the base-emitter voltage of transistor Q5, sets up across resistor R11 and does not change until Q5 shuts off. If resistor R10 is selected as 100 kΩ, resistor R11 is selected as 10 kΩ, and the Vbe to turn OFF transistor Q5 is 0.65 volts, then when the voltage across the divider is 7.15 volts the transistor Q5 will shut OFF. Using 7.15 volts as Vc, assuming an input voltage of +30 volts, and selecting 2.2 μF for capacitor C5, the on time of transistor Q5 calculated per equation (1) will be about 315.5 msec. The temporary ON state of transistor Q5 is designed to be long enough to draw current through resistors R1 and R2 so that the power control transistor Q1 is latched into its ON, conducting state by the latching circuitry 28 in the same manner described above relative to the closure of switch S1.

R12 is provided in the kick-start circuit 22 to bleed off the high potential side of capacitor C5 if the power source is disconnected or AC power is lost. The diode D1 quickly discharges the low potential side of capacitor C5 and clamps at most to −0.7 volts when power is lost.

The described circuit provides an improved technique for controlling delivery of power from a DC power source to an electronic controller in a device capable of printing on media. The power control circuit 16 is connected between the DC power source and the electronic controller and has a latchable power delivery state (e.g., transistor Q1 ON) in which power is delivered from the DC power source to the electronic controller. The power control circuit also has a power non-delivery state (e.g., transistor Q1 OFF) in which DC power is not delivered from the DC power source to the electronic controller. The power control circuit includes a user closeable switch S1 and a kick-start circuit portion 22. When the power control circuit is in the power non-delivery state, the power control circuit latches into its power delivery state in response to temporary closure of the user closeable switch. When the power control circuit is in the power non-delivery state, the power control circuit latches into its power delivery state in response to initial output of power from the DC power source.

Although the invention has been described above in detail referencing the illustrated embodiment thereof, it is recognized that various changes and modifications could be made.

What is claimed is:

1. A printer, comprising:

a DC power source;

an electronic controller for controlling operations of the printer including a printing mechanism of the printer;

a power control circuit connected between the DC power source and the electronic controller for controlling delivery of DC power to the electronic controller, the power control circuit comprising:

a power control transistor connected between the DC power source and the electronic controller, an ON state of the power control transistor effecting DC power delivery to the electronic controller, an OFF state of the power control transistor preventing DC power delivery to the electronic controller;

a user closeable switch connected in line with at least one other circuit component that receives power from the DC power source when the user closeable switch is closed to set up a voltage condition across terminals of the power control transistor that places the power control transistor in its ON state, the user closeable switch biased into an open condition; and latching circuitry connected in the power control circuit, the latching circuitry latching into a conducting state upon closure of the user closeable switch to maintain the voltage condition even after the user closeable switch returns to its open condition; and a switch condition feedback path from the power control circuit to the electronic controller for providing a switch closed signal to the electronic controller when the user closeable switch is closed;

a control path connected between the electronic controller and the latching circuitry;

when the power control transistor is in its ON state and the electronic controller is receiving DC power, the electronic controller responds to receipt of a switch closed signal by modifying an output on the control path to cause the latching circuitry to unlatch into a non-conducting state thereby eliminating the voltage condition and placing the power control transistor in its OFF state.

2. The printer of claim 1 wherein the latching circuitry comprises a first transistor connected in series with a resistor, the first transistor placed in its conducting state by closure of the user closeable switch, and a second transistor that is placed in its conducting state by a voltage set up across the resistor when the first transistor is conducting, conduction of the second transistor maintains the first transistor in its conducting state even when the user closeable switch is in its open condition, and the control path connects to a control input of the second transistor.

3. The printer of claim 1, further comprising a kick-start circuit connected to the power control circuit and configured to temporarily set up the voltage condition when DC power is initially output by the power source, the kick-start circuit sets up the voltage condition for a time period sufficient to cause the latching circuitry to latch into its conducting state.

4. The printer of claim 3 wherein the kick-start circuit comprises a transistor connected in parallel with the user closeable switch, a voltage divider connected to a control input of the transistor and a capacitor connected in series with the voltage divider.

5. The printer of claim 4 wherein the kick-start circuit further includes a resistor connected in parallel with the series connected capacitor and voltage divider.

6. The printer of claim 5 wherein the kick-start circuit further includes a diode connected in parallel with the voltage divider.

7. A printer, comprising:

a DC power source;

an electronic controller for controlling operations of the printer including a printing mechanism of the printer;

a power control circuit including a power control transistor connected between the DC power source and the electronic controller, an ON state of the power control transistor effecting DC power delivery to the electronic controller, an OFF state of the power control transistor preventing DC power delivery to the electronic controller, and latching circuitry connected to the power control transistor and having a latched state that maintains a voltage condition across terminals of the power control transistor to hold the power control transistor in its ON state; and a kick-start circuit connected to the power control circuit and configured to temporarily set up the voltage condition in response to DC power being initially output by the power source, the kick-start circuit sets up the voltage condition for a time period sufficient to cause the latching circuitry to latch into its latched state.

8. The printer of claim 7 wherein the kick-start circuit comprises a transistor connected to receive power from the DC power source, a voltage divider connected to a control input of the transistor and a capacitor connected in series with the voltage divider.

9. The printer of claim 8 wherein the kick-start circuit further includes a resistor connected in parallel with the series connected capacitor and voltage divider.

10. The printer of claim 9 wherein the kick-start circuit further includes a diode connected in parallel with the voltage divider.

11. The printer of claim 7 where the latched state is a conducting state of the latching circuitry and the printer further comprises:

a control path connected between the electronic controller and the latching circuitry enabling the electronic controller to place the latching circuitry into a non-conducting state to thereby place the power control transistor in its OFF state.

12. The printer of claim 11 wherein the electronic controller is operable to place the latching circuitry into its non-conducting state when the electronic controller detects at least one predetermined condition.

13. The printer of claim 12 wherein the predetermined condition comprises closure of a user closeable switch.

14. The printer of claim 13 wherein the user closeable switch is connected in the power control circuit and the printer includes a switch condition feedback path from the power control circuit to the electronic controller for providing a switch closed signal to the electronic controller when the user closeable switch is closed.

15. A printer, comprising:

a DC power source;

an electronic controller for controlling operations of the printer including a printing mechanism of the printer and at least one other printer component;

a power control circuit connected between the DC power source and the electronic controller for controlling delivery of DC power to the electronic controller, the power control circuit including latching circuitry for latching the power control circuit in a power delivery state to deliver DC power through the power control circuit to the electronic controller; and a control path connected between the electronic controller and the latching circuitry enabling the electronic controller to unlatch the power control circuit into a power non-delivery state that causes cessation of DC power delivery through the power control circuit to the electronic controller.

16. The printer claim 15 wherein the electronic controller is operable to unlatch the power control circuit when the electronic controller detects at least one predetermined condition.

17. The printer of claim 16 wherein the predetermined condition comprises closure of a user controlled switching device.

18. The printer of claim 17 wherein the user controlled switching device is connected in the power control circuit and the printer includes a switching device condition feedback path from the power control circuit to the electronic controller for providing a switching device closed signal to the electronic controller when the user controlled switching device is closed.

19. The printer of claim 15 wherein the electronic controller controls operations of at least one motor in the printer and at least one display of the printer.

20. A printer, comprising:

a DC power source;

an electronic controller operatively connected with a printing mechanism of the printer;

a power control circuit connected between the DC power source and the electronic controller, the power control circuit having a latchable power delivery state in which power is delivered from the DC power source to the electronic controller, the power control circuit having a power non-delivery state in which DC power is not delivered from the DC power source to the electronic controller, the power control circuit including a user controlled switching device connected therein and a kick-start circuit portion;

when the power control circuit is in the power non-delivery state, temporary closure of the user controlled switching device causes the power control circuit to latch into its power delivery state; and when the power control circuit is in the power non-delivery state, initial output of power from the DC power source causes the kick-start circuit portion to latch the power control circuit into its power delivery state.

21. The printer of claim 20, further comprising:

a control path from the electronic controller to the power control circuit, wherein when the power control circuit is latched in its power delivery state, output of a control signal from the electronic controller to the power control circuit on the control path causes the power control circuit to unlatch into its power non-delivery state.

22. The printer of claim 21 wherein the electronic controller is operable to output the control signal responsive to detection of temporary closure of the user controlled switching device.

23. The printer of claim 22 wherein the electronic controller effects a device shut down sequence prior to outputting the control signal.

24. The printer of claim 20 wherein the kick-start circuit portion temporarily conducts current in response to initial output of power from the DC power source in order to latch the power control circuit into its power delivery state.

25. A power control circuit for use in an electronic device, the power control circuit comprising:

an input for connecting to a power source to receive power therefrom, an output for connecting to an electronic controller of an electronic device, a power control transistor connected between the input and the output, an ON state of the power control transistor making a power path from the input to the output, an OFF state of the power control transistor breaking the power path;

a switch connected in line with at least one other circuit component and the input for setting up a voltage condition across terminals of the power control transistor when the switch is closed to place the power control transistor in its ON state, the switch biased into an open condition; and latching circuitry connected in the circuit for latching into a conducting state upon closure of the switch to maintain the voltage condition even after the switch returns to its open condition, wherein the latching circuitry consists of analog circuitry having a non-conducting state in which current draw from the DC power source through the latching circuitry is eliminated;

a switch condition feedback output for outputting a switch closed signal when the switch is closed;

a control input to the latching circuitry for receiving a control signal that causes the latching circuitry to unlatch into its non-conducting state thereby eliminating the voltage condition and placing the power control transistor in its OFF state.

26. The power control circuit of claim 25, further comprising:

a kick-start circuit connected to temporarily set up the voltage condition responsive to when DC power is initially received at the input, the kick-start circuit configured to set up the voltage condition for a time period sufficient to cause the latching circuitry to latch into its conducting state.

27. A power control circuit for use in an electronic device, the power control circuit comprising:

an input for connecting to a power source to receive power therefrom, an output for connecting to an electronic controller of an electronic device, a power control transistor connected between the input and the output, an ON state of the power control transistor making a power path from the input to the output, an OFF state of the power control transistor breaking the power path;

latching circuitry connected to the power control transistor and having a latchable conducting state for maintaining the power control transistor in its ON state; and a kick-start circuit connected to temporarily set up a voltage condition across terminals of the power control transistor in response to power being initially received at the input, the voltage condition placing the power control transistor in its ON state, the kick-start circuit configured to set up the voltage condition for a time period sufficient to cause the latching circuitry to latch into its conducting state.

28. The power control circuit of claim 27, wherein the latching circuitry includes a control input for receiving a control signal to place the latching circuitry into a non-conducting state.

29. A printer, comprising:

a DC power source;

an electronic controller for controlling operations of the printer including a printing mechanism of the printer and at least one other printer component;

a power control circuit connected between the DC power source and the electronic controller for controlling delivery of DC power to the electronic controller, the power control circuit comprising:

a switching device connected between the DC power source and the electronic controller, a closed state of the switching device effecting DC power delivery to the electronic controller, an open state of the switching device preventing DC power delivery to the electronic controller;

a user controlled switch connected in line with at least one other circuit component that receives power from the DC power source when the user controlled switch is closed to set up a condition in the power control circuit that places the switching device in its closed state, the user controlled switch being normally open; and latching circuitry connected in the power control circuit, the latching circuitry latching into a power on state upon closure of the user controlled switch to maintain the condition even after the user controlled switch opens, wherein the latching circuitry is formed by analog circuitry having a non-conducting state in which current draw from the DC power source through the latching circuitry is eliminated.

30. The printer of claim 29 wherein the latching circuitry comprises a first transistor connected in series with a resistor, the first transistor is placed in its conducting state by closure of the user controlled switch, and a second transistor that is placed in its conducting state by a voltage set up across the resistor when the first transistor is conducting, conduction of the second transistor maintains the first transistor in its conducting state even when the user controlled switch is in its open condition.

31. A printer, comprising:

a DC power source;

an electronic controller for controlling operations of the printer including a printing mechanism of the printer;

a power control circuit including a switching device connected between the DC power source and the electronic controller, a closed state of the switching device effecting DC power delivery to the electronic controller, an open state of the switching device preventing DC power delivery to the electronic controller, and latching circuitry connected to the switching device and having a latched state that maintains a circuit condition that holds the switching device in its closed state; and a kick-start circuit connected to the power control circuit and configured to temporarily set up the circuit condition in response to DC power being initially output by the power source, the kick-start circuit sets up the circuit condition for a time period sufficient to cause the latching circuitry to latch into its latched state.

* * * * *